US005709058A

United States Patent [19]

Shaw

[11] Patent Number: 5,709,058

[45] Date of Patent: Jan. 20, 1998

[54] WALL CONSTRUCTION SYSTEM EMPLOYING COVERING TILES

[76] Inventor: William S. Shaw, 4247 Baker Place, Prince George, B.C., Canada, V1H 1A7

[21] Appl. No.: 529,226

[22] Filed: Sep. 15, 1995

[30] Foreign Application Priority Data

Sep. 15, 1994 [CA] Canada ..... 2132168

[51] Int. Cl.[6] ..... E04B 2/28

[52] U.S. Cl. ..... 52/404.1; 52/282.1; 52/384; 52/508; 52/562; 52/762; 52/763; 52/764; 52/780; 52/781; 52/742.13

[58] Field of Search ..... 52/309.11, 404.1, 52/742.13, 506.03, 508, 509, 562, 282.1, 764, 772, 780, 781, 384, 386, 762, 763

[56] References Cited

U.S. PATENT DOCUMENTS

| | | | |
|---|---|---|---|
| 658,868 | 10/1900 | Rosenbaum . | |
| 2,101,612 | 12/1937 | Duffy . | |
| 2,104,085 | 1/1938 | Leland | 52/509 |
| 2,245,785 | 6/1941 | Jentzer, Jr. | 52/508 |
| 2,309,695 | 2/1943 | Droeger . | |
| 2,832,102 | 4/1958 | Amoruso . | |
| 3,248,838 | 5/1966 | Stark | 52/508 |
| 3,611,664 | 10/1971 | Barbera | 52/764 X |
| 3,694,981 | 10/1972 | Cremer et al. . | |
| 3,702,044 | 11/1972 | Balinski | 52/781 X |
| 4,516,373 | 5/1985 | Osawa . | |
| 4,640,076 | 2/1987 | Migliore | 52/509 |
| 4,809,470 | 3/1989 | Bauer et al. . | |
| 4,987,712 | 1/1991 | Mancuso . | |
| 5,245,809 | 9/1993 | Harrington | 52/309.11 |
| 5,277,009 | 1/1994 | Yamaguchi et al. . | |

*Primary Examiner*—Christopher Kent
*Attorney, Agent, or Firm*—Kolisch, Hartwell, Dickinson, McCormack & Heuser

[57] ABSTRACT

A construction unit and method for forming an exterior surface on a support framework. The construction unit includes a plurality of tiles for forming a finishing layer on the support framework. Mounting brackets are attachable to the support framework to position the tiles at a distance from the support framework to define an internal cavity between the support framework and tiles. An adhesive, filler material is introduced into the internal cavity to bind together the support framework, the tiles and the mounting brackets to form a consolidated construction unit. In a stud frame building, modified mounting brackets can be used that position the tiles directly against an exterior face of the stud frame wall. The adhesive, filler material contacts and binds the tiles through the openings in the stud framework.

11 Claims, 2 Drawing Sheets

WALL CONSTRUCTION SYSTEM EMPLOYING COVERING TILES

FIELD OF THE INVENTION

This invention relates to a construction unit that uses tiles applied to a support framework to provide a finished wall or roof surface.

BACKGROUND OF THE INVENTION

Using tiles to cover and decorate buildings with a finished surface is a technique that has been known for centuries. The general technique involves covering an underlying support wall with an adhesive mortar mixture and then pressing tiles into place in the mixture to form a finishing surface. It requires skilled craftsmen to apply the tiles. The process is generally slow and material and labour costs tend to be high, and, therefore the technique is not in wide spread use to finish the exterior of buildings.

Prior art systems have been developed to mount covering tiles on external support walls using a mounting and retaining system for the tiles other than mortar. For example, U.S. Pat. No. 5,277,009 to Yamaguchi et al. discloses a wall unit that uses mountable siding members adapted to receive specially formed interlocking tiles. U.S. Pat. No. 3,694,981 to Creamer et al. discloses a wall finishing system that comprises an array of mounting brackets attached to a support wall with retaining clips connecting specially made finishing tiles to the brackets.

The foregoing systems suffer from some of their own disadvantages. Installation tends to be slow and materials are expensive as specially manufactured tiles are necessary.

SUMMARY OF THE INVENTION

There is therefore a need for a construction unit that addresses the shortcomings of the prior art.

The construction unit and method of the present invention allow for very quick and easy installation using standard ceramic tiles. The resulting construction unit is extremely strong and durable.

Accordingly, the present invention provides a construction unit for forming an exterior surface on a support framework comprising:

- at least one covering unit for forming a finishing layer on the support framework;
- spacing and retaining means attachable to the support framework to position the at least one covering unit at a distance from the support framework to define an internal cavity between the support framework and the at least one covering unit; and
- adhesive, filler material introducible into the internal cavity to bind together the support framework, the at least one covering unit and the spacing and retaining means to form a consolidated construction unit.

In a further aspect, the present invention provides a method for forming an exterior surface on a support framework comprising the steps of:

- applying spacing and retaining means to the support surface;
- mounting at least one covering unit in the spacing and retaining means to form a finishing layer a distance from the support framework to define an internal cavity between the support framework and the at least one covering unit; and
- introducing an adhesive, filler material into the internal cavity to bind together the support framework, the at least one covering unit and the spacing and retaining means to form a consolidated construction unit.

The construction technique of the present application can be used to form external walls or roofs. The adhesive, filler material is preferably an insulation foam that performs the dual roles of binding the tiles together and waterproofing and insulating the unit.

Preferably, inexpensive extruded aluminum brackets are used as the spacing and retaining means. The method of the present invention also permits the use of inexpensive standard tiles of any size. It is simply a matter of adjusting the spacing of the brackets to accommodate different sizes of tile.

The construction unit and method of the present application are particulary suited for use with buildings constructed using stud framing with regular openings in the support framework. In an alternative arrangement that is possible in stud framing buildings, the mounting brackets are formed to permit attachment of the tiles to the stud framing without defining a space between the support wall and tiles. The openings in the stud framing receive the insulation foam to bind the construction unit together.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
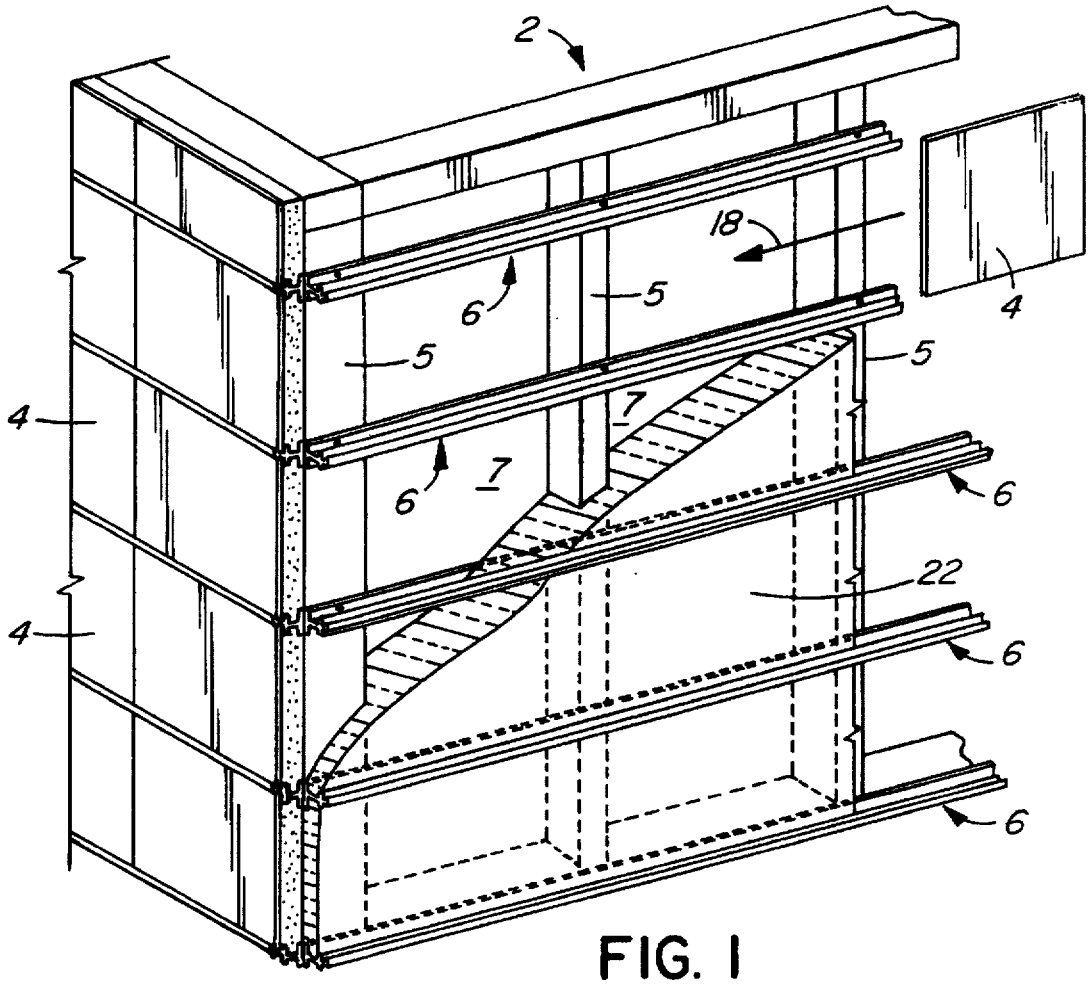
FIG. 1 is a perspective view with cutaway sections of a preferred embodiment of the construction unit of the present invention.

Referring to FIG. 1, there is shown a preferred embodiment of the construction unit of the present invention with cutaway sections. The construction unit is shown mounted to standard woodframe support walls 2 formed from studs 5 extending between a header and footer, however, it will be understood that the construction unit of the present invention can be mounted to other types of support walls where a finishing surface is desired.

The construction unit uses covering units, preferably in the form of ceramic tiles 4, for forming a finishing layer on the support framework 2. An advantage of the system of the present invention is that standard ceramic tiles of any size, such as those used in floor construction, can be used. Such floor tiles are available in standard thicknesses and come in many colours or patterns. Also, thicker tiles known in the trade as "Quarry tiles" can be used. In general, it is recommended that tiles of the same area and thickness be used at a particular project.

Figure 2:
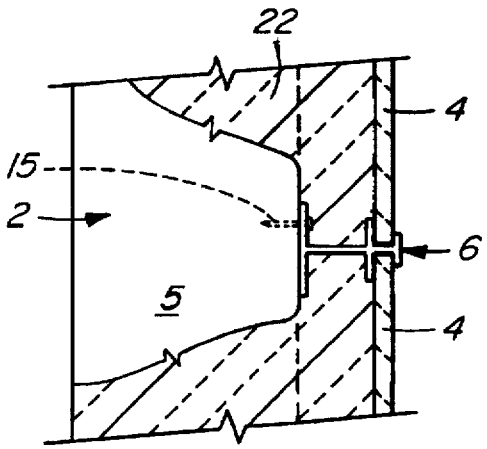
FIG. 2 is a detail view through the construction unit.
Figure 3:
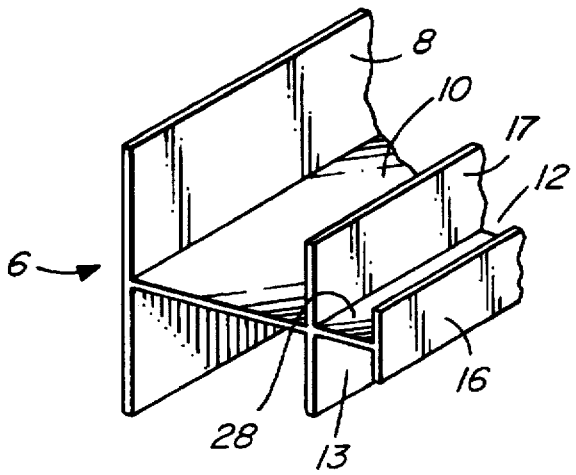
FIG. 3 is a detail view of a preferred embodiment of a mounting bracket.

The tiles are mounted to the support wall 2 by spacing and retaining means comprising a series of mounting brackets 6. As best shown in FIGS. 2 and 3, each mounting bracket 6 comprises an elongated strip that is attachable to the support framework 2 to support an edge of a tile 4. FIG. 3 is a detail view of a section of a mounting bracket comprising a mounting flange 8 for attachment directly to the support framework and a spacing web 10 extending outwardly from the mounting flange terminating in a pair of opposed retaining channels 12 and 13 for receiving the edges of a pair of adjacent tiles. Preferably, the mounting brackets are formed from extruded aluminium.

Referring to FIG. 2, each bracket is mounted to support wall 2 by a fastening member 15, such as a screw or nail, driven through mounting flange 8. Brackets 6 are preferably arranged on the support wall 2 in parallel, horizontal rows spaced according to the dimensions of the tiles to be used to form the finishing surface. The retaining channels 12 and 13 of adjacent pairs of mounting brackets co-operate to slidably receive and retain a series of tiles. The retaining channels are defined by a vertical rear flange 17, horizontal surface 28 and a vertical front flange 16. When constructing a unit according to the present invention, it is simply a matter of sliding tiles 4 into place between adjacent mounting brackets 6 as indicated by arrow 18 in FIG. 1. Tiles 4 are abutted directly against each other in each row to define a finished surface. Placement of the tiles within bracket channels 12 and 13 leaves an exposed bracket surface 16. Optionally, front flange 16 is formed as a finishing strip. The surface of flange 16 can be the same colour as the tiles to hide the joints between tiles. Alternatively, flange 16 can be a different colour to accentuate the joints between rows of tiles, if desired.

The brackets are not limited to being arranged in horizontal rows. Depending on the desired appearance of the finishing surface, brackets 6 can be arranged vertically or even diagonally as long as the brackets are positioned parallel to each other to accept tiles 4.

It is apparent from the foregoing description that various tile patterns can be quickly and easily formed on the support wall to create a finishing layer that is spaced a distance away from the support wall by virtue of spacing web 10 of the mounting bracket. Web 10 creates an internal cavity 20 between the support framework 2 and the layer of tiles 4.

The tiles of the construction unit of the present invention are fixed into position by adhesive, filler material 22 that is introduced into internal cavity 20. In the case of a stud wall structure, filler material 22 is preferably applied after any electrical wiring or plumbing is installed. Material 22 acts to bind together the support wall 2, the tiles 4 and mounting brackets 6 to form a consolidated construction unit of considerable strength. The mounting brackets act as reinforcing bars within the interior of the construction unit. Preferably, adhesive, filler material 22 comprises a polyurethane insulation foam that is sprayed into internal cavity 22 wet and expands and sets into a solid mass. When the support wall is a stud frame unit as illustrated in FIG. 1, the insulation foam can be sprayed directly into the openings 7 between studs 5. If electrical or plumbing connections have not bee laid out prior to spraying, appropriate passages can be cut in the hardened foam to accommodate them. The insulation foam automatically binds together the various components of the construction unit and insulates and waterproofs the structure. It is intended that mounting brackets 6 will be available with different lengths of spacing web 10. By selecting a mounting bracket with a particular web length, it is possible to select a particular resulting thickness of insulation and hence the R-value of the structure to be formed.

Figure 4:
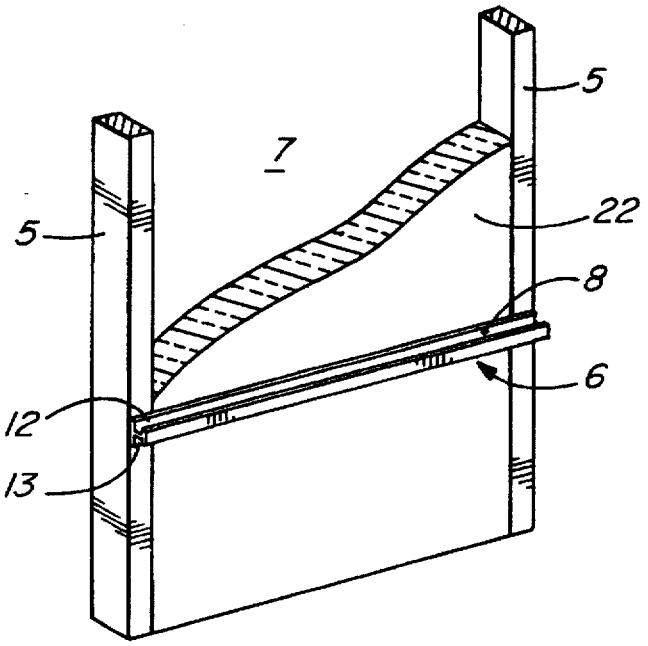
FIG. 4 is a view of an alternative construction unit for use with a stud frame support wall.

An alternative arrangement of the present invention that is particulary suited for wooden stud frame construction is illustrated in FIG. 4. This alternative arrangement employs mounting brackets 6 that do not include a spacing web 10. Retaining channels 12 and 13 extend directly from mounting flange 8. In this alternative embodiment, the thickness of adhesive, filler material 22 within openings 7 between any two adjacent studs 5 determines the insulation value. Varying the insulation value involves varying the depth of openings 7 by using wider studs 5.

Figure 5:
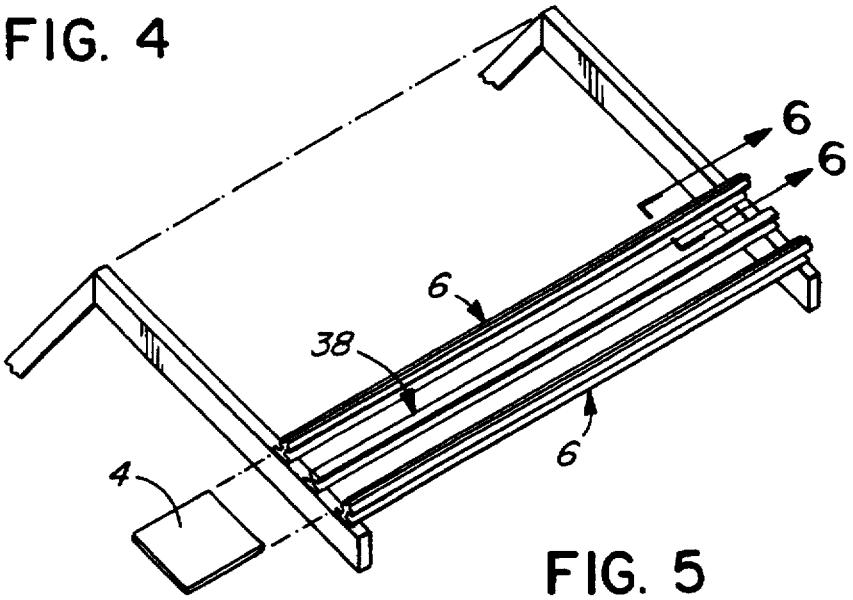
FIG. 5 is a view of a construction unit used as a roof unit.
Figure 6:
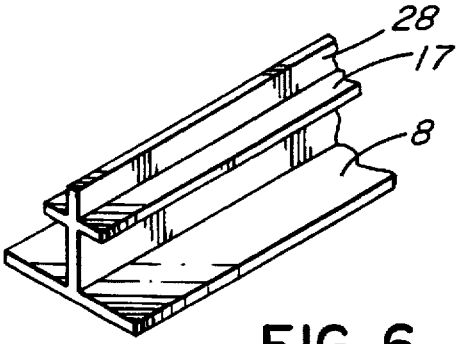
FIG. 6 is a detailed view of a portion of a mounting bracket used with the roof unit of FIG. 5.

The foregoing description is directed to the installation of a construction unit according to the present invention as a wall unit. It will be readily apparent to those skilled in the art that the construction unit of the present invention is also suitable for use as a roof unit. In a roof unit, as illustrated in FIGS. 5 and 6, the mounting brackets 6 are preferably modified so that the flange 16 is removed and tiles 4 can be placed directly on top of rear flange 17. Horizontal surface 28 separates tiles in adjacent rows and gravity initially holds the tiles in place until insulation foam is sprayed into place. In addition, on a roof unit, modified mounting brackets 38 that have had surface 28 removed are positioned to support the middle of a tile between the edges. In other words, if 18 inch square tiles are used, modified mounting brackets 38 are spaced at 9 inches between regular mounting brackets 6. On a roof unit, the joints between tiles are preferably filled with sealant material to prevent water from entering and freezing within a joint.

In summary, the construction unit of the present invention permits quick and efficient assembly of a wall or roof construction unit that is strong and durable. The unit is automatically insulated for heat and sound by virtue of the insulation material that also acts to bind the unit together. The unit eliminates the need for the plywood panels, building paper and plastic that are used currently to seal the outside of a woodframe building, thereby resulting in reduced material and labour costs.

Although the present invention has been described in some detail by way of example for purposes of clarity and understanding, it will be apparent that certain changes and modifications may be practised within the scope of the appended claims.

I claim:

1. A construction unit for forming an exterior surface on a support framework comprising:

at least one covering unit for forming a finishing layer on the support framework;

spacing and retaining means attachable to the support framework comprising elongate mounting brackets having a mounting flange for attachment to the support framework and a spacing web extending outwardly from the mounting flange terminating in at least one retaining channel slidably receiving the at least one covering unit and to position the at least one covering unit at a distance from the support framework to define an internal cavity between the support framework and the at least one covering unit; and adhesive, filler material introduced into the internal cavity to bind together the support framework, the at least one covering unit and the spacing and retaining means to form a consolidated construction unit.

2. A construction unit as claimed in claim 1 in which the adhesive, filler material comprises an insulation foam that is sprayed into the internal cavity wet and expands and sets into a solid mass.

3. A construction unit as claimed in claim 2 in which the insulation foam is polyurethane foam.

4. A construction unit as claimed in claim 1 in which the at least one covering unit comprises a tile.

5. A construction unit as claimed in claim 4 in which a plurality of tiles are arranged in a pre-selected pattern to define a finishing layer.

6. A construction unit as claimed in claim 1 in which each mounting bracket is formed with a pair of adjacent, opposed terminal retaining channels whereby a plurality of mounting brackets are mountable to the support framework in an array of parallel brackets, the retaining channels of adjacent pairs of mounting brackets co-operating and slidably receiving and retaining a plurality of covering units.

7. A construction unit as claimed in claim 1 in which the mounting brackets include a finishing strip adjacent the at least one retaining channel.

8. A construction unit as claimed in claim 1 in which the mounting brackets are formed from extruded aluminum.

9. A method for forming an exterior surface on a support framework comprising the steps of:

applying spacing and retaining means—comprising elongate mounting brackets formed with channels—to the support framework;

mounting at least one covering unit in the spacing and retaining means—by sliding the unit into the channels—to form a finishing layer a distance from the support framework to define an internal cavity between the support framework and the at least one covering unit; and introducing an adhesive, filler material into the internal cavity to bind together the support framework, the at least one covering unit and the spacing and retaining means to form a consolidated construction unit.

10. A method as claimed in claim 9 in which the spacing and retaining means comprises a plurality of mounting brackets, each mounting bracket having a mounting flange for attachment to the support framework and a spacing web extending outwardly from the mounting flange terminating in retaining channels for receiving at least one covering unit and the applying step comprises applying an array of parallel mounting brackets on the support framework.

11. A method as claimed in claim 9 in which the step of introducing an adhesive, filler material comprises spraying a wet insulation foam into the internal cavity, the foam expanding and setting into a solid mass.

* * * * *